US006520671B1

(12) United States Patent
Halter et al.

(10) Patent No.: US 6,520,671 B1
(45) Date of Patent: Feb. 18, 2003

(54) ROTATABLE HOPPER HAVING TWIN SCREWS

(75) Inventors: Roland Halter, St. Gallen (CH); Achim Sturm, Oberuzwil (CH); Bernhard Stalder, Niederuzwil (CH)

(73) Assignee: Buhler AG, Uzwil (CH)

( * ) Notice: Subject to any disclaimer, the term of this patent is extended or adjusted under 35 U.S.C. 154(b) by 0 days.

(21) Appl. No.: 09/744,251

(22) PCT Filed: Oct. 14, 1999

(86) PCT No.: PCT/CH99/00485

§ 371 (c)(1),
(2), (4) Date: Jan. 31, 2001

(87) PCT Pub. No.: WO00/21863

PCT Pub. Date: Apr. 20, 2000

(30) Foreign Application Priority Data

Oct. 14, 1998 (DE) ..... 198 47 241

(51) Int. Cl.[7] ..... B01F 9/16

(52) U.S. Cl. ..... 366/76.4; 366/156.2; 366/224; 366/301

(58) Field of Search ..... 366/51, 186, 190, 366/76.6, 194–196, 222–224, 287, 288, 297–301, 318, 76.4, 156.2

(56) References Cited

U.S. PATENT DOCUMENTS

| | | | | | |
|---|---|---|---|---|---|
| 2,345,063 | A | * | 3/1944 | Nauta | 366/287 |
| 2,831,663 | A | * | 4/1958 | Nauta | 366/287 |
| 2,893,709 | A | * | 7/1959 | Nauta | 366/287 |
| 3,315,947 | A | * | 4/1967 | Nauta | 366/287 |
| 3,338,562 | A | * | 8/1967 | Fox | 366/287 |
| 3,533,604 | A | * | 10/1970 | Sabelis | 366/287 |
| 3,614,070 | A | * | 10/1971 | Loomans | |
| 3,659,826 | A | * | 5/1972 | Nauta | |
| 3,746,314 | A | * | 7/1973 | Nauta | |
| 4,123,174 | A | * | 10/1978 | Titus | 366/287 |
| 4,217,996 | A | * | 8/1980 | Good | 366/287 |
| 4,422,772 | A | * | 12/1983 | Baumgartner | 366/287 |
| 4,437,766 | A | * | 3/1984 | Joachim | 366/287 |
| 4,516,860 | A | * | 5/1985 | Van Der Laan et al. | 366/287 |
| 5,505,537 | A | * | 4/1996 | Previero | 366/314 |

FOREIGN PATENT DOCUMENTS

| | | | | |
|---|---|---|---|---|
| DE | 3029684 | * | 4/1982 | |
| EP | 126437 | * | 11/1984 | 366/224 |
| FR | 820147 | * | 11/1937 | 366/224 |
| FR | 1572866 | * | 6/1969 | |
| FR | 1583977 | * | 12/1969 | 366/224 |
| FR | 2484967 | * | 12/1981 | |
| GB | 1041619 | * | 9/1966 | 366/287 |
| GB | 2014865 | * | 9/1979 | 366/224 |
| NL | 281191 | * | 12/1964 | 366/287 |
| NO | 74446 | * | 12/1948 | 366/287 |
| SU | 173584 | * | 1/1963 | |
| SU | 993993 | * | 2/1983 | 366/287 |
| SU | 1449351 | * | 1/1989 | |
| SU | 1533862 | * | 1/1990 | 366/287 |

* cited by examiner

*Primary Examiner*—Charles E. Cooley
(74) *Attorney, Agent, or Firm*—Oblon, Spivak, McClelland, Maier & Neustadt, P.C.

(57) ABSTRACT

A device for dosing and/or mixing highly viscous and non-flowable materials, especially pigment pastes. The device includes a funnel which revolves about its own axis and a twin screw arranged inside the funnel. The twin screw arranged in a horizontal position in the funnel and contacts the interior wall thereof. This arrangement ensures that all moveable parts of the device mutually strip and clean one another.

10 Claims, 1 Drawing Sheet

ROTATABLE HOPPER HAVING TWIN SCREWS

BACKGROUND OF THE INVENTION

1. Field of the Invention

The present invention relates to a device for dosing and/or mixing highly viscous and non-flowable materials, more especially pigment pastes.

2. Discussion of the Background

The device is used in continuously operating and closed systems, more especially for dosing highly viscous and non-flowable materials in an extruder.

In a continuously operating and closed system the material can be supplied, for example, by means of an SRB-83076 Bühler pump whereby the pasty mass must be pressed into the pump from a hopper since it is barely drawn in by the pump itself. This can be accomplished by means of a pusher or a feed screw. It has been found that sticky non-flowing pastes adhere to the hopper and the feed components (feed screws, pushers). The adhered paste can only be loosened by scraping the components. In accordance with the principle of the invention all components in contact with product should mutually scrape each other and simultaneously press the material into the pump. For pasts which only acquire a pumpable consistency by shearing, such as pigment press cake for example, the material should be sheared by the scraping components. At the present state of the art several devices are known for dosing, or filling or discharging material.

German Patent Specification No. 1 180 321 discloses a silo with a discharging device having a rotatable bottom surface with driving vanes so that a considerable fraction of the fuel supply in the silo is rotated. The discharging device is a screw which is located directly above the contact surface and conveys the material from the center of the bottom radially towards a conveyor system positioned outside the silo.

Austrian Patent Specification No. 217959 describes a device for discharging masses from a silo and similar structures. In a cylindrical container with its bottom sloping towards the middle there is provided a drain hole. A radially configured screw rotates around the center, of the container and thereby sweeps the entire bottom of the container. In addition to the circling movement the screw spiral also executes a turning movement about its own longitudinal axis.

German Patent Specification DE 3304026 A1 discloses a silo with a discharging device which is provided with a screw which rotates such that the silo material is conveyed towards a feeder. When used as a distributing device the screw is driven in the opposite direction. In contrast to this, at the upper end of a conveyor shaft there-is provided another screw conveyor which can swing vertically towards the conveyor shaft and can rotate therein.

SUMMARY OF THE INVENTION

The problem for the present invention is to provide constant dosing of highly viscous and non-flowable materials such as pigment concentrates of all types (pigment press cake, offset pastes, offset concentrates, flush pastes), Aerosil pastes, die-stamping paints, all types of putty, gel pastes, gelled binders and so on. The device developed should avoid all the afore-mentioned disadvantages (adhesion of lumps, possible bridge formation).

The problem according to the invention is solved with the characteristics of the present invention. The invention starts from the afore-mentioned hopper which is used as a dosing device, as the latest technological development.

The problem is solved by the fact that a double screw is provided inside the hopper and the hopper turns about its own vertical axis. The screw replaces the currently used pusher or scraper which is usually positioned on the inner wall of the hopper. The screws brush each other and continuously brush the hopper wall. By means of the turning movement of the hopper, the product is continuously brushed away from the entire hopper wall.

Other advantageous embodiments of the invention are protected with the supplementary claims and result from these claims themselves or from combinations thereof.

It is advantageous for the distance between the inner wall of the hopper and the double screw to be in the range 0–3 cm.

It is advisable for the double screw to run along the hopper wall into a product outlet aperture at the lower end of the hopper.

It is advantageous for the screws of the double screw to be driven in the same direction or in opposite directions.

It is advantageous for the double screw to be driven in the same direction or in the opposite direction to the hopper.

It is advisable for the conveying capacity of the double screw to be higher than the conveying capacity of the pump.

It is advantageous that the screws beneath the hopper should be run through a housing to the pump.

It is advisable that the rotation rates of the screw should be in the range 20–100 rpm and those of the hopper should be in the range 1–5/min.

BRIEF DESCRIPTION OF THE DRAWINGS

The invention is subsequently explained in greater a detail using the figures.

DESCRIPTION OF THE PREFERRED EMBODIMENTS

Figure 1:
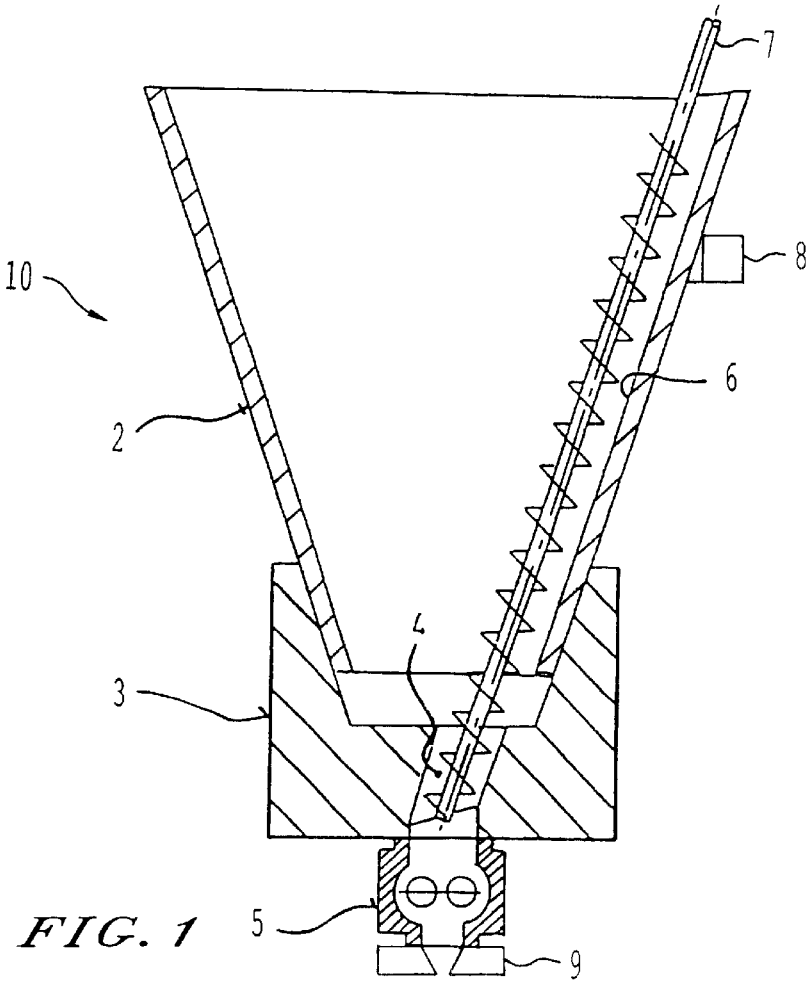
FIG. 1 is a schematic side view of a hopper with a double screw.

The materials are transferred into a hopper 2, for example, from barrels or by suitable means of transport, both not shown. On the one hand, the product is conveyed downwards in the direction of the product outlet aperture 4 on a relatively small scale by the rotating hopper 2 itself and, on the other hand, is conveyed by the double screw 1. The screw fulfils two functions, namely brushing away and conveying the product. The pasty mass adhering to the inner wall 6 of the hopper is brushed away by the mutual rotation of the hopper 2 by a mechanism 8 for rotating the hopper, for example, and the screws 1*a* and 1*b*. The rotations of the screws can be matched to one another and, if necessary, regulated. It has been found that when the components in FIG. 2 rotate in the same direction, the material is strongly sheared and within a few minutes all the material contained in the hopper 2 is mixed.

Figure 2:
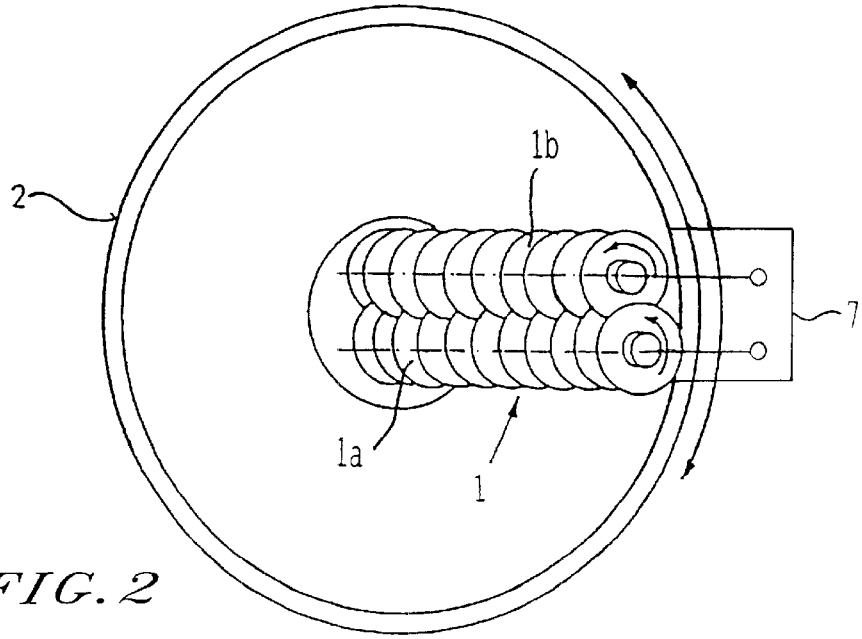
FIG. 2 is a top view of the hopper showing the directions of rotation of both moving parts.

FIG. 2 shows the single screws 1*a* and 1*b* which can be driven by a mechanism 7 for driving such screws in the same direction or in opposite directions. By means of these rotations the product is conveyed downwards in the direction of the product outlet aperture 4 in a housing 3 in FIG.

1 and is simultaneously sheared. This configuration has the effect that all parts of the device, including the hopper wall, brush against each other, possibly cleaning themselves. For operation with the pump 5 it is important that the conveying capacity of the double screw 1 is higher than the conveying capacity of the pump. The product then packs itself back in the hopper. Pump 5 can be in communication with an extruder 9 and the extruder assembly of the structure noted above formed a system 10 as shown in FIG. 1.

Both flat- and concave-section screws are especially suited to the present device. An SRB-83076 Bühler pump is also used.

What is claimed is:

1. A device for metering and/or mixing substantially highly viscous, non-flowable materials, comprising:

a housing having an outlet aperture formed therein;

a pump positioned in proximity with the outlet aperture of the housing;

a hopper mounted on said housing, said hopper being rotatable about an axis thereof; and material conveying means positioned in said hopper and extending in proximity with an inner wall of the hopper, the materials being guided to a position beneath the hopper through the outlet aperture of the housing and to a position in proximity with said pump by said material conveying means, said material conveying means comprising one of a twin screw and a double screw assembly having first and second screws which extend parallel to one of a mantle line and a generating line of the substantially conical wall of the hopper and through said housing outlet aperture to said pump and wherein in operation said screws and said substantially conical wall contact the material so as to mix the material and simultaneously force the material into the pump.

2. A device according to claim 1, wherein a distance between the wall of the hopper and the screws is in the range of 0–3 cm.

3. The device according to claim 1, wherein the screws extend along the substantially conical wall of the hopper to communicate the material to a position in proximity with an outlet portion of the outlet aperture and a lower end portion of the housing.

4. A device according to claim 1, which comprises a mechanism for driving the screws in the same rotational direction.

5. The device according to claim 1, which comprises a mechanism for driving the screws in opposite rotational directions.

6. A device according to claim 1, which comprises a mechanism for driving the screws in one of the same rotational direction and opposite rotational directions as compared with the direction of rotation of the hopper.

7. The device according to claim 1, wherein the conveying capacity of the screws is greater than the conveying capacity of the pump.

8. A device according to claim 1, which comprises a mechanism for rotating the screws in a range of 20–100 rpm and a mechanism engageable with the hopper for rotating the hopper in a range of 1–5 rpm.

9. An extruder assembly having a device for metering and/or mixing substantially highly viscous, non-flowable materials, comprising:

a housing having an outlet aperture formed therein;

a pump positioned in proximity with the outlet aperture of the housing;

a hopper mounted on said housing, said hopper being rotatable about an axis thereof;

an extruder connected to said housing; and material conveying means rotatably positioned in said hopper and extending in proximity with an inner wall of the hopper, the materials being guided to a position beneath the hopper through the outlet aperture of the housing and to a position in proximity with said pump by said material conveying means, said material conveying means comprising one of a twin screw and a double screw assembly having first and second screws which extend parallel to one of a mantle line and a generating line of the substantially conical wall portion of the hopper and through said housing outlet aperture to said pump and wherein in operation said screws and said substantially conical wall contact the material so as to mix the material and simultaneously force the material into the pump.

10. A system having a device for metering and/or mixing substantially highly viscous, non-flowable materials, comprising:

a housing having an outlet aperture formed therein;

a pump positioned in proximity with the outlet aperture of the housing;

a hopper mounted on said housing, said hopper being rotatable about an axis thereof; and material conveying means movably positioned in said hopper and extending in proximity with an inner wall of the hopper, the materials being guided to a position beneath the hopper through the outlet aperture of the housing and to a position in proximity with said pump by said material conveying means, said material conveying means comprising one of a twin screw and a double screw assembly having first and second screws which extend parallel to one of a mantle line and a generating line of a substantially conical wall portion of the hopper and through said housing outlet aperture to said pump and wherein in operation said screws and said substantially conical wall contact the material so as to mix the material and simultaneously force the material into the pump.

* * * * *